US008079243B2

(12) United States Patent
Okui et al.

(10) Patent No.: US 8,079,243 B2
(45) Date of Patent: Dec. 20, 2011

(54) PLUG, METHOD OF EXPANDING INSIDE DIAMETER OF METAL PIPE OR TUBE USING SUCH PLUG, METHOD OF MANUFACTURING METAL PIPE OR TUBE, AND METAL PIPE OR TUBE

(75) Inventors: Tatsuya Okui, Osaka (JP); Koichi Kuroda, Osaka (JP); Masayoshi Akiyama, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 826 days.

(21) Appl. No.: 11/663,429

(22) PCT Filed: Sep. 15, 2005

(86) PCT No.: PCT/JP2005/017444

§ 371 (c)(1),
(2), (4) Date: May 9, 2008

(87) PCT Pub. No.: WO2006/033376

PCT Pub. Date: Mar. 30, 2006

(65) Prior Publication Data

US 2008/0216544 A1 Sep. 11, 2008

(30) Foreign Application Priority Data

Sep. 21, 2004 (JP) ..... 2004-273836

(51) Int. Cl.

| | |
|---|---|
| ***B21B 19/04*** | (2006.01) |
| ***B21B 17/10*** | (2006.01) |
| ***B21D 39/08*** | (2006.01) |

(52) U.S. Cl. ..... 72/97; 72/209; 72/370.06

(58) Field of Classification Search ..... 72/97, 208, 72/209, 283, 370.1, 370.11, 370.03, 370.06, 72/370.07, 370.23, 393

See application file for complete search history.

(56) References Cited

U.S. PATENT DOCUMENTS

| | | | | |
|---|---|---|---|---|
| 4,161,112 | A * | 7/1979 | Stump | 72/283 |
| 4,203,313 | A | 5/1980 | Kunzli et al. | |
| 5,348,095 | A | 9/1994 | Worrall et al. | |
| 6,988,387 | B2 * | 1/2006 | Nakaike et al. | 72/97 |
| 7,013,697 | B2 * | 3/2006 | Barber | 72/370.06 |

FOREIGN PATENT DOCUMENTS

| | | |
|---|---|---|
| JP | 61-067528 | 4/1986 |
| JP | 62-24827 | 2/1987 |
| JP | 2001-113329 | 4/2001 |

* cited by examiner

*Primary Examiner* — Dana Ross
*Assistant Examiner* — Teresa M Bonk
(74) *Attorney, Agent, or Firm* — Clark & Brody

(57) ABSTRACT

The plug is for expanding the inside diameter of the end portion of a metal pipe. Its cross section is a circle, and includes a taper portion and a parallel portion connected to the tail end of the taper portion. The diameter of the taper portion gradually increases from the head end of the taper portion to the tail end of the taper portion where the diameter is D1. The axial distance LR from the point where the diameter D2=D1× 0.99 to the tail end where the diameter is D1 satisfies the Expression 22≦LR/((D1−D2)/2)≦115. The taper angle on the surface where the diameter is D2 is larger than or equal to the taper angle on the tail surface of the taper portion following the point where the diameter is D2. The diameter of the parallel portion is D1.

4 Claims, 7 Drawing Sheets

PLUG, METHOD OF EXPANDING INSIDE DIAMETER OF METAL PIPE OR TUBE USING SUCH PLUG, METHOD OF MANUFACTURING METAL PIPE OR TUBE, AND METAL PIPE OR TUBE

TECHNICAL FIELD

The present invention relates to a plug for expanding the inside diameter of an end portion of metal pipe or tube, a method of expanding the inside diameter of an end portion of a metal pipe or tube using such plug, and a method of manufacturing a metal pipe or tube.

BACKGROUND ART

High-dimensional precision is required on the end portion of a metal pipe or tube supplied for service as a line pipe or as oil country tubular goods. In the supply of the service, a line pipe is usually welded to its adjacent line pipe. If the inside diameter of the end portion of a line pipe does not precisely meet with that of the adjacent line pipe, it leads to trouble with welding which causes defects of the welded portion. Ordinary oil country tubular goods are subjected to threading operation on the end portions in order to connect them to their adjacent oil country tubular goods. If the precision of the inside diameter of the parent oil country tubular goods are poor, the threading operation cannot be completed properly.

In order to improve the precision of the inside diameter of the end portions of a metal pipe or tube, the end portions are expanded.

The equipment for the expanding operation includes a chuck 2, a plug 3, and a cylinder 4 as shown in FIGS. 1A, 1B, and 1C. Starting from the head to the tail of the plug 3, the geometry of the plug 3 includes the taper portion 31 which smoothly connects to the parallel portion 32. The diameters at both ends of the taper portion 31 are D10 on the head end and D11 on the tail end, with D11 being larger than D10. The taper angle R1 of the taper portion 31 is constant. The diameter of the parallel portion 32 is uniform throughout the longitudinal direction and is given as D11.

Prior to the expanding operation of an end portion of a metal pipe (or a metal tube) 1, the metal pipe 1 is tightly fixed to the equipment using the chuck 2. In fixing the metal pipe 1, its center axis is arranged so that it precisely meets with the center axis of the plug 3 as shown in FIG. 1A. Then the plug 3 is pushed into the metal pipe 1 to the prescribed distance in the axial direction from the end point as shown in FIG. 1B. The plug 3 is pushed into the metal pipe 1 by using the cylinder 4. The end portion of metal pipe 1 is expanded accordingly.

After the plug 3 travels the prescribed distance from the end point of the metal pipe 1, the plug 3 is pulled back in the direction opposite to the direction that it was pushed in as shown in FIG. 1C. Through this procedure the end portion of the metal pipe 1 is finished so that the precision of the inside diameter of the end portion precisely meets the prescribed value. Improvement of the dimensional precision of the inside diameter of the end portion of the metal pipe 1 is obtained accordingly.

A problem, however, is that there is a difference in the inside diameter in the circumferential direction on the expanded end portion of the metal pipe, and the inside geometry of the cross section is not a perfect circle. There is also a difference in the inside diameter in the axial direction.

DISCLOSURE OF THE INVENTION

It is an object of the invention to provide a plug that ensures the improvement of dimensional precision of the end portion of a metal pipe or tube, a method of expanding the inside diameter of an end portion of metal pipe or tube using the plug, and a method of manufacturing a metal pipe or tube.

In order to investigate the cause of the difference in the inside diameter of the expanded end portion of a metal pipe 1, the inventors expanded an end portion of a metal pipe by using a plug with a conventional geometry. The result showed that the inside diameter D20 of the expanded portion of the metal pipe 1 was larger than the outside diameter D11 of the parallel portion 32 of the plug 3 as shown in FIG. 2. In the following part of this specification, this excessive deformation is called overshooting deformation.

When the end portion of a metal pipe 1 is expanded by a plug 3, the portion 11 on the metal pipe where the taper portion 31 of the plug 3 is passing undergoes bending deformation toward the outside direction of the metal pipe 1, and the portion 11 of the metal pipe 1 is expanded in its inside diameter as a result. Although the portion 12 on the metal pipe 1 where the parallel portion 32 of the plug 3 is passing undergoes no bending deformation by the taper portion 31 of the plug 3, the portion 12 of the metal pipe 1 is influenced by the bending deformation of the portion 11 of the metal pipe 1 caused by the taper portion 31 of the plug 3. Because of this mechanism, overshooting deformation occurs on the expanded portion 12 of the metal pipe 1.

Throughout the overshooting deformation, the inside surface of the expanded portion 12 of the metal pipe 1 is not in contact with the surface of the parallel portion 32 of the plug 3. In other words, there is no constraint on the parallel portion 32 of the plug 3 given by the metal pipe 1, and the metal pipe 1 receives no reaction force from the parallel portion 32 of the plug 3 accordingly. Therefore, the inside surface of the expanded portion 12 of the metal pipe 1 becomes unstable allowing a non-uniform overshooting deformation. Because of this non-uniform overshooting deformation the inside diameter of the expanded portion 12 of the metal pipe 1 is not constant in the circumferential direction, and the cross section of the expanded portion 12 of the metal pipe 1 is not a perfect circle. For the same reason, the inside diameter of the expanded portion 12 of the metal pipe 1 becomes non-uniform in the axial direction.

The inventors drew a conclusion that dimensional precision of the inside surface of the expanded portion of the metal pipe 1 was improved if overshooting deformation was prevented from occurring on the expanded portion 12 of the metal pipe 1 when the parallel portion 32 of the plug 3 is passing there. If overshooting deformation is avoided, the inside surface of the metal pipe 1 contacts the surface of the parallel portion 32 of the plug 3, and the inside diameter of the expanded portion 12 of the metal pipe 1 becomes equal to the diameter of the parallel portion 32 of the plug 3.

In order to prevent overshooting deformation from occurring on the expanded portion 12 of the metal pipe 1, it is sufficient to allow the overshooting deformation to start and to be completed before the inside diameter of the metal pipe 1 is expanded to D11 by the plug 3. In other words, it is sufficient to allow overshooting deformation to start and to be completed only in the portion 11 of the metal pipe 1 where the taper portion 31 of the plug 3 is passing.

The inventors carried out an investigation on overshooting deformation by expanding the end portions of the metal pipes 1 having wide ranges of inside diameter and wall thickness using the plug 3. The newly-found results showed that overshooting deformation was less than 1% of the diameter D11 of the parallel portion 32 of the plug 3 when the expansion ratio given by Expression (A) is equal to or less than 8%. The intensity of overshooting deformation was dependent neither upon the wall thickness nor upon the inside diameter of the metal pipe 1.

$$\text{Expansion Ratio}=(D20-D30)/D30\times100(\%) \quad (A)$$

Where D30 is the inside diameter of the metal pipe 1 before it is expanded, and D20 is the inside diameter of the metal pipe 1 after it is expanded.

Based on the study and results of examination as described above, the inventors have made the plug according to the invention.

The plug according to the invention is for expanding the inside diameter of an end portion of a metal pipe. The plug has a circular cross section, and including a taper portion and a parallel portion connected to the tail end of the taper portion. The diameter of the taper portion gradually increases from the head end of the taper portion to the tail end of the taper portion where the diameter is D1. The axial distance LR from a point of the taper portion where the diameter is D2=D1×0.99 to the tail end where the diameter is D1 satisfies Expression (1). The taper angle on the surface where the diameter is D2 is larger than or equal to the taper angle on the tail surface of the taper portion following the point where the diameter is D2, and the diameter of the parallel portion is D1.

$$22\leqq LR/((D1-D2)/2)\leqq115 \quad (1)$$

For the present invention plug the taper angle on the surface of the plug where the diameter is D2 in the taper portion is larger than or equal to the taper angle of the consecutive portion of the plug, and the length LR satisfies Expression (1). Therefore, a metal pipe or tube undergoes little bending deformation by the plug surface after the point where the plug diameter is D2. As a result, the plug is eligible to generate overshooting deformation when the metal pipe or tube is passing over the tail surface of the plug from the point where the diameter of the plug is D2. As is described above, the intensity of overshooting deformation is less than 1% of the diameter D1 of the parallel portion of the plug, and overshooting deformation finishes when the metal pipe or tube is passing over the zone of the plug defined by the point where the diameter of the plug is D2 and the end point of the taper portion. In other words, the portion of the metal pipe or tube where the parallel portion of the plug is passing does not undergo overshooting deformation. Hence, the inside surface of the metal pipe or tube contacts the surface of the parallel portion of the plug. Due to the influence of this effect, the inside diameter of the metal pipe or tube becomes equal to the diameter of the parallel portion of the plug, and the dimensional precision of the expanded portion of the metal pipe or tube increases.

A method of expanding the inside diameter of an end portion of a metal pipe or tube according to the present invention includes the steps of pushing the plug into the metal pipe or tube in the axial direction from an end of the metal pipe or tube for a prescribed distance, and stopping pushing the plug and retracting in the inverse direction to the outside of the metal pipe or tube.

In the expanding method of the inside diameter of an end portion of a metal pipe or tube according to present invention the metal pipe or tube is expanded by using the above-described plug. Hence, the inside diameter of the end portion of the metal pipe or tube becomes equal to the diameter of the parallel portion of the plug, and the dimensional precision of the inside diameter is improved.

The method of manufacturing a metal pipe or tube according to the present invention includes the steps of piercing a billet in the axial direction to manufacture a hollow shell, elongating said hollow shell in the axial direction, sizing the outside diameter of the elongated hollow shell to manufacture the metal pipe or tube, pushing a plug into the metal pipe or tube in the axial direction from an end of the metal pipe or tube for a prescribed distance, and stopping pushing the plug and retracting in the inverse direction to the outside of the metal pipe or tube.

In the method for manufacturing a metal pipe or tube according to the present invention, the parent metal pipe or tube is expanded in its inside diameter by using the above-described plug. Hence, the inside diameter of the end portion of the metal pipe or tube exactly meets the diameter of the parallel portion of the plug, and the dimensional precision of the inside diameter of the expanded portion is improved.

A metal pipe or tube according to the invention includes a first hollow cylindrical portion near the center portion of the metal pipe or tube, a second hollow cylindrical portion on at least one of the two end portions of the metal pipe or tube, and a taper portion connecting the first and the second hollow cylindrical portions. The outside diameter of the first hollow cylindrical portion is DA, and the outside diameter of the second hollow cylindrical portion is DB which is larger than the outside diameter DA of the first hollow cylindrical portion. The outside diameter of the taper portion gradually increases from the first hollow cylindrical portion to the second hollow cylindrical portion. The axial distance LE lying between the points of the taper portion where the outside diameters are DC=DB×0.99 and DB satisfies Expression (2):

$$22\leqq LE/((DB-DC)/2)\leqq115 \quad (2)$$

BEST MODE FOR CARRYING OUT THE INVENTION

Figure 1A:
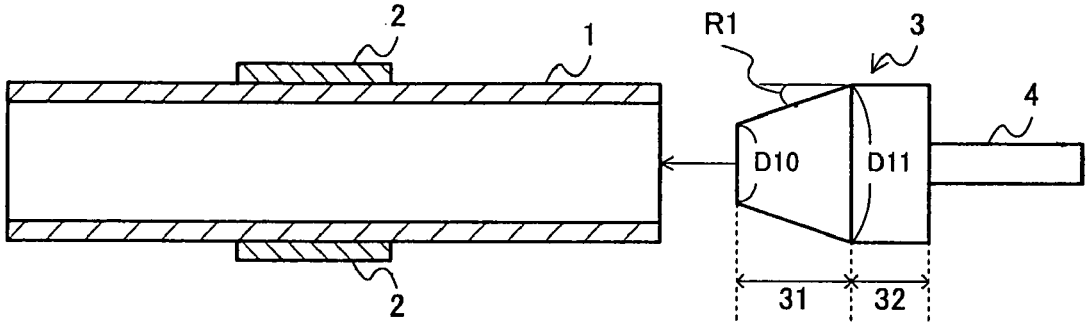
Fig.1A PRIOR ART
FIGS. 1A to 1C are views showing first to third steps in the process of expanding a pipe using a conventional plug.
Figure 1B:
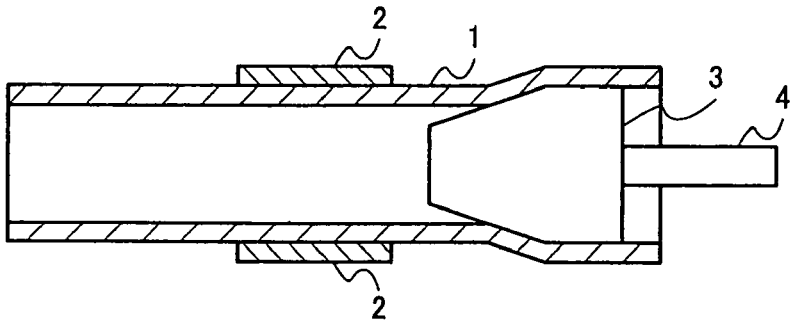
Fig.1B PRIOR ART
Figure 1C:
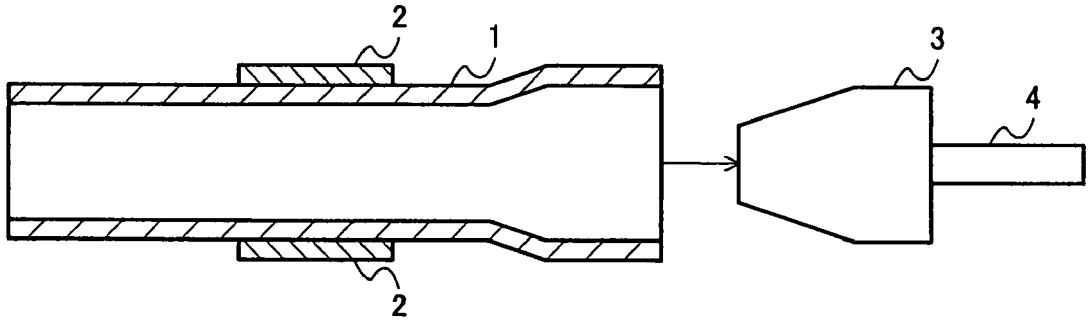
Fig.1C PRIOR ART
Figure 2:
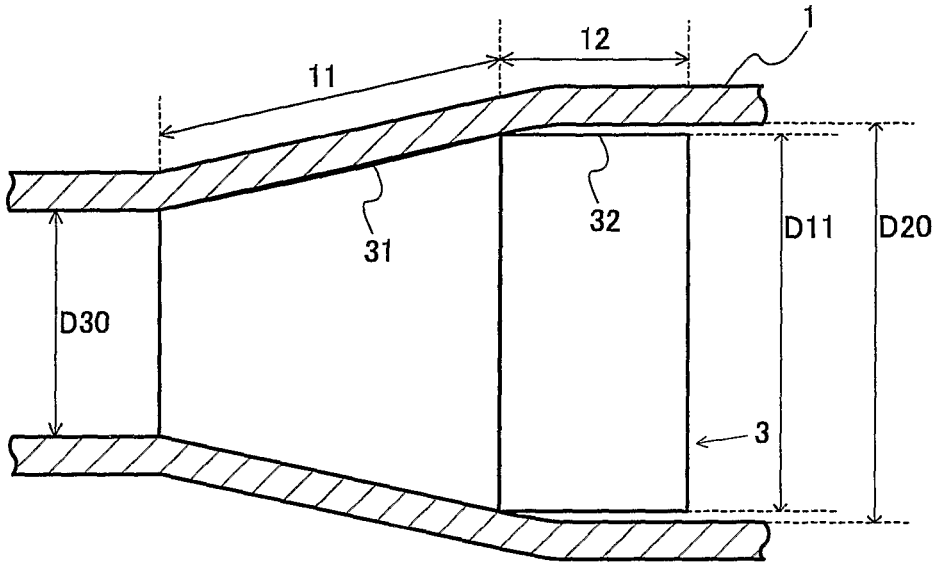
FIG. 2 is a schematic view for use in illustrated explanation on the cause of discrepancy in the inside diameter of the expanded portion by the expansion process.

Now, an embodiment of the invention will be detailed in conjunction with the accompanying drawings in which the same or corresponding parts are denoted by the same reference characters and the same description is not repeated.

1. Plug

Figure 3:
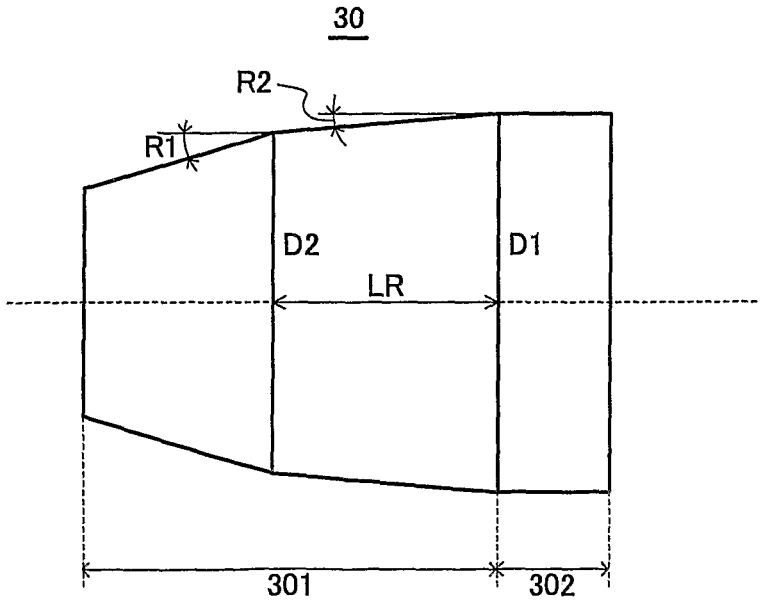
FIG. 3 is a side view of a plug geometry according to an embodiment of the present invention.

Referring to FIG. 3, according to the embodiment includes such geometry that starts from the taper portion 301 from the head followed by the continuing parallel portion 302. The geometry of the cross section of the plug 30 is a circle.

The taper portion 301 has such role as to expand the inside diameter of the end portion of the metal pipe or tube. The diameter of the taper portion 301 gradually increases from the head end of the taper portion 301 toward the tail end of the taper portion 302 where the diameter is D1.

In the taper portion 301, the taper angle R1 on the surface at the point where the diameter D2=D1×0.99 is larger than the taper angle on the tail surface of the taper portion 302 following the point where the diameter is D2. In addition, the axial distance LR lying between the points with the diameter D2 and the diameter D1 satisfies the following Expression (1):

$$22 \leqq LR/((D1-D2)/2) \leqq 115 \quad (1)$$

Figure 4:
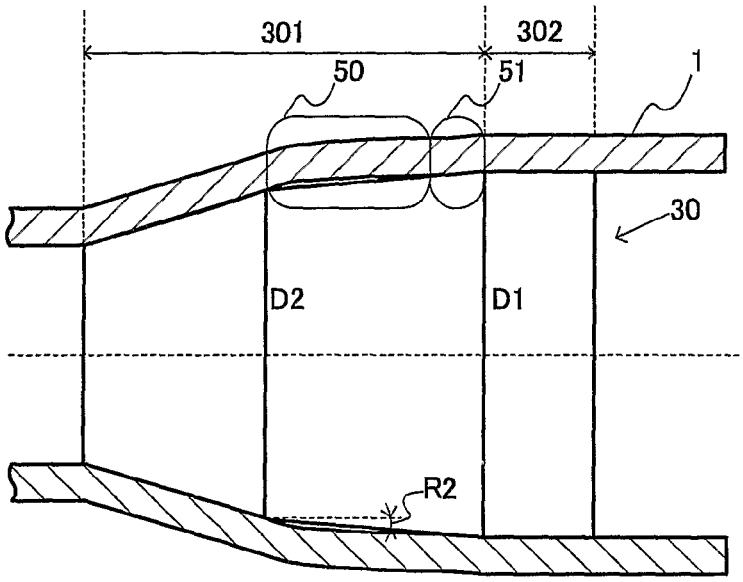
FIG. 4 is a schematic view for use in illustrated explanation on the deformation process of the metal pipe or tube expanded by using the plug shown in FIG. 3.

In order to prevent overshooting deformation from occurring when the metal pipe or tube passes over the parallel portion 302 in the expanding operation, it is sufficient to allow the initiation of overshooting deformation to start while the metal pipe is passing over the taper portion 301, and to let it finish in the taper portion 301. The taper angle R2 can be made smaller by adopting large LR to a given (D1−D2). For such a geometry, as shown in FIG. 4, the plug 30 does not contact the inside surface of the metal pipe or tube 1 on the surface of the tail zone 50 after the point where the diameter of the plug is D2. Overshooting deformation occurs on the metal pipe or tube 1 when the metal pipe or tube 1 is in the rear zone 50.

When the expansion ratio of a metal pipe or tube 1 is less than or equal to 8%, the intensity of overshooting deformation is less than 1% of D1 as is described above. Therefore, if the inventors allow that overshooting deformation occurs in the zone 50 connecting immediately after the point where the diameter of the plug is D2 (=D1×0.99), the inside diameter of the metal pipe or tube 1 after the completion of overshooting deformation does not exceed D1.

The inside surface of the metal pipe 1 after overshooting deformation contacts again the taper portion 301 of the plug and is slightly expanded in the zone 51 until it reaches the inlet point of the parallel portion of the plug. However, the taper angle R2 of the plug 30 surface is small as is described above and the expansion ratio given to the metal pipe or tube 1 in the zone 51 is very small. In other words, the contact force exerting on the inside surface of the metal pipe or tube 1 by the taper portion 301 of the plug 30 in the zone 51 is very small. Hence, overshooting deformation due to exerting force on the inside surface of the metal pipe or tube 1 in the zone 51 hardly occurs. As a result, the inside surface of the metal pipe or tube 1 contacts the surface of the parallel portion 302 of the plug 30 while it is passing over the parallel portion 302.

Because of this mechanism, the inside diameter is always kept constant as D1 with no fluctuation of inside diameter in the longitudinal and the circumferential directions when an expanding operation of inside diameter of the end portion of metal pipe or tube is carried out by using the plug 30 with the geometry according to the embodiment.

When the axial distance LR is not less than the lower threshold value in Expression (1), the effect described above most efficiently appears The reason for the upper threshold value 115 in Expression (1) is that if the axial distance LR exceeds this value, the total length of the plug 30 becomes so long that it raises both the manufacturing cost of the plug and the manufacturing cost of the equipment for expansion operation. In short, the effect of the present invention clearly appears even when the upper threshold value is larger than 115.

The above-described effect is most efficiently obtained when the expansion ratio is less than or equal to 8%, but it is also obtainable to some extent when the expansion ratio is higher than 8%.

Figure 5:
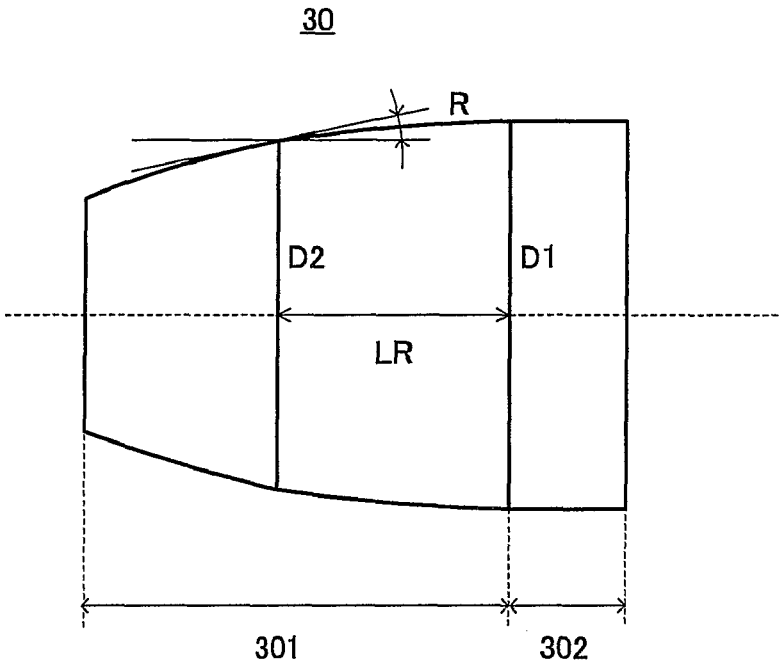
FIG. 5 is a side view of a plug with different geometry of the embodiment of the invention.

Although the geometry of the taper portion 301 is straight in FIG. 3, other geometries of this portion are also allowed. For example, a curved surface on the taper portion 301 is also allowed as shown in FIG. 5. In short, it is sufficient that the diameter of the taper portion 301 gradually increases from the head end of the taper portion 301 toward the tail end of the taper portion 301 where the diameter is D1 satisfying such conditions that the taper angle R1 is larger than the taper angle R2 and the axial distance LR satisfies Expression (1). The taper angle R defined for such a plug 30 having a curved geometry on the taper portion 301 in FIG. 5 is the angle formed by a tangent line on the surface of the taper portion 301 and a line parallel to the axis of the plug 30. More specifically, the angle formed by the tangent line on the surface at a point where the diameter of the plug 30 is D2 and a line parallel to the axis of the plug 30 is the taper angle R1, and the angle formed by the tangent line on the tail surface of the taper portion 302 following the point where the diameter is D2 and a line parallel to the axis of the plug 30 is the taper angle R2.

Although the two taper angles R1 and R2 are different in FIG. 3, it is allowed for these angles to have the same value. When a metal pipe or tube is expanded by a plug having a constant taper angle R2 and satisfying Expression (1), overshooting deformation hardly occurs on the metal pipe or tube passing over the taper portion and the parallel portion of the plug. Therefore, the effect of the present invention can be efficiently obtained. However, the cost of the expanding equipment is high because the axial length of the plug from the head end of the taper portion to the point where the diameter is D2 is large for such a plug.

In short, it is sufficient that the taper angles satisfy such relationship as R1≧R2 and the axial distance LR satisfies Expression (1).

There is no restriction on the plug material. For example, the material can be either high-speed steel or cemented carbide. There is no restriction on the surface roughness of the plug 30, and a finished surface by coating is also acceptable.

2. Manufacturing Method

A method of manufacturing a metal pipe or tube according to the embodiment will be described. Molten steel is produced either by a blast furnace or by an electric furnace and is then refined by a conventional method.

After the refinement is completed, the molten steel is processed by a continuous casting method or by an ingot casting method to be for example, a slab, a bloom, a billet or an ingot.

The slab, bloom or ingot is processed by hot working to be a billet. The hot working process can be either a hot rolling process or hot forging process.

In the following process, a billet is pierced by a piercing mill to be a hollow shell (piercing process). The hollow shell is elongated in the longitudinal direction by a mandrel mill (elongating process). After the elongating process, the outside diameter of the hollow shell is sized to the specified value (sizing process).

After the sizing process, the end portion of the hollow shell (metal pipe or tube) is expanded (expanding process). In the following paragraph, explanation is given on the expanding process, namely, the method for expanding the end portion of a metal pipe or tube.

Figure 6A:
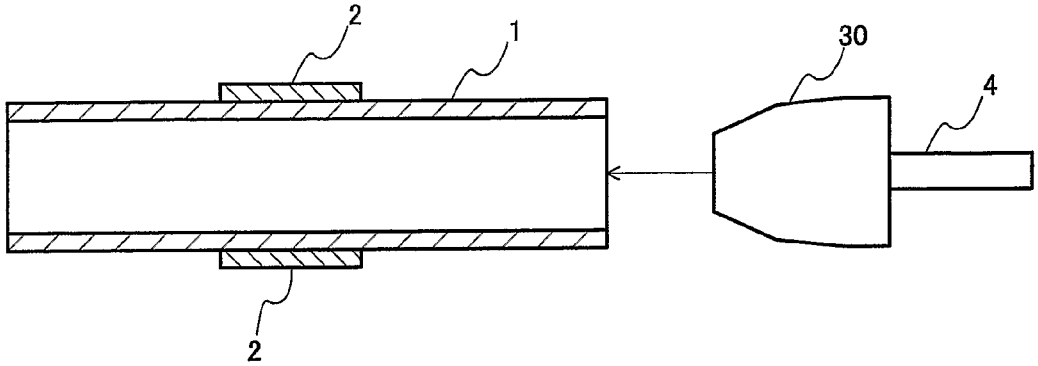
FIGS. 6A to 6C are views showing first to third steps in the process of expanding a metal pipe or tube using the plug shown in FIG. 3.
Figure 6B:
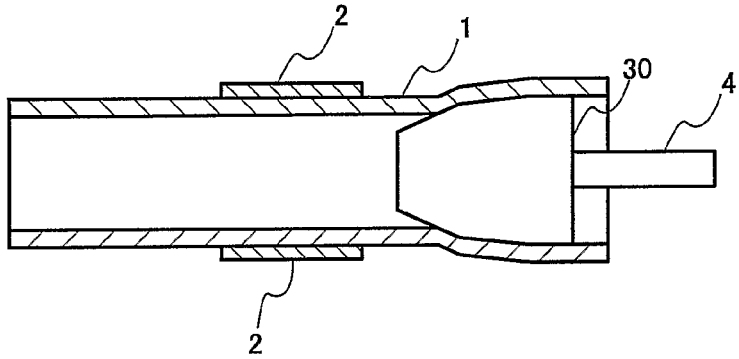
Figure 6C:
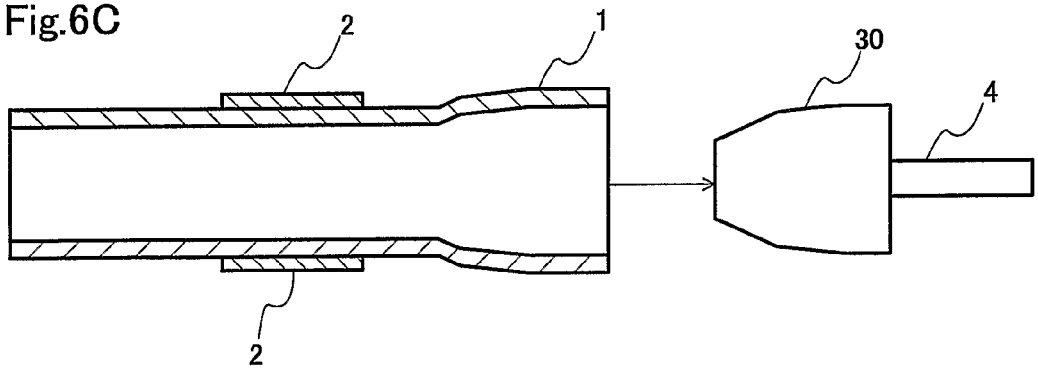

As shown in FIGS. 6A through 6C, the equipment for the expanding operation includes a chuck 2 and a cylinder 4. A metal pipe or tube 1 supplied after the sizing process is fixed to the expanding equipment by the chuck 2. A plug 30 is positioned on the top of the cylinder 4 of the expanding equipment by a well-known method. Adjustment is made on the precise alignment of the axis of the metal pipe or tube 1 and that of the plug 30 (FIG. 6A).

After adjusting the two axes of the plug 30 and the metal pipe or tube 1 concentric at the same position, the plug 30 is pushed into the metal pipe or tube 1 from an end to a specified position. Because of this operation the end portion of the metal pipe or tube 1 is expanded by the plug 30 (FIG. 6B). After the plug 30 is pushed to the specified position the plug 30 is pulled back in the inverse direction by using the cylinder 4 and taken out of the metal pipe or tube 1 (FIG. 6C).

Figure 6D:
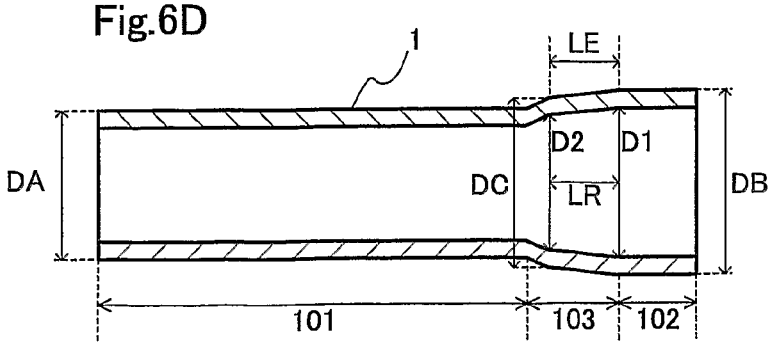
FIG. 6D is a side view of a metal pipe or tube expanded using the plug shown in FIG. 3.

The metal pipe or tube 1 manufactured by the above-described process includes a first hollow cylindrical portion 101, the second hollow cylindrical portion 102 on the end of the metal pipe or tube 1, and the taper portion 103 which smoothly connects the first and the second hollow cylindrical portions (FIG. 6D). The outside diameter of the first hollow cylindrical portion 101 is DA, and the outside diameter DB of the expanded second hollow cylindrical portion 102 is larger than DA.

The geometry of the taper portion 103 of the expanded pipe or tube 1 is determined by the geometry of the plug 30. The inside diameter of the taper portion 103 of the metal pipe or tube 1 gradually increases from the inside diameter of the first portion 101 to the inside diameter D1 of the second portion 102. The axial distance LR lying between the point where the inside diameter of the metal pipe or tube 1 is D2=D1×0.99 to the point where the inside diameter of the metal pipe or tube 1 is D1 satisfies Expression (1). In short, the inside geometry of the taper portion 103 of the metal pipe or tube 1 is nearly the same as the outside geometry of the taper portion 103 of the plug 30.

The outside geometry of the taper portion 103 of the metal pipe or tube 1 is nearly the same as the inside geometry of the taper portion 103 of the metal pipe or tube 1. To be precise, the outside diameter of the taper portion 103 gradually increases from the value DA on the first hollow cylindrical portion 101 to DB on the second hollow cylindrical portion 102. In addition, the axial distance LE lying between the point of the taper portion 103 where the outside diameter is DC=DB×0.99 and the point of the taper portion 103 where the outside diameter is DB satisfies the following Expression (2):

$$22 \leqq LE/((DB-DC)/2) \leqq 115 \quad (2)$$

Figure 7A:
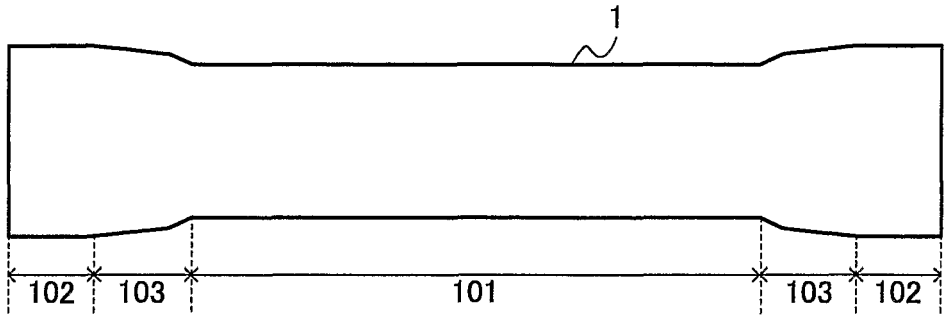
FIGS. 7A and 7B are side views of other examples of metal pipes or tubes expanded using the plug shown in FIG. 3.
Figure 7B:
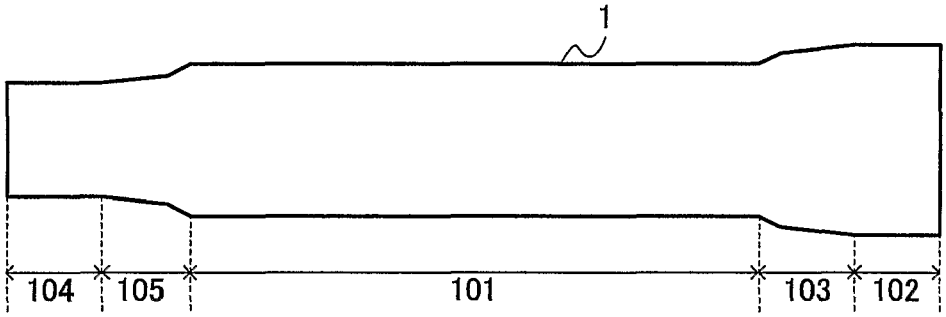

The geometry of the expanded metal pipe or tube 1 by the above-described expanding method can be either like that illustrated in FIG. 6D or like that having two expanded ends 102 as shown in FIG. 7A. Alternatively, it can also be like that illustrated in FIG. 7B with one end having an expanded second hollow cylindrical portion 102, the other end having a reduced third hollow cylindrical portion 104 and a cylindrical taper portion 105 connecting smoothly the third hollow cylindrical portion 104 and the first hollow cylindrical portion 101. The geometry of the third hollow cylindrical portion 104 and the cylindrical taper portion 105 are formed, for example, by using such method that the end portion of the metal pipe 1 is pushed into a die.

In the above-described manufacturing method, the expanding process is placed after the sizing process, but it is allowed to place a process for straightening the bent portion of the hollow shell or a process for improving the roundness of the hollow shell prior to the sizing process. For example, the straightness of the hollow shell can be achieved by allowing the hollow shell to go through a straightener.

It is also allowed to give the hollow shell a thermal treatment to regulate or improve the strength or ductility of the hollow shell in between the sizing process and the straightening process.

It is allowed to reduce the end portion of the metal pipe or tube by a swaging process in order to regulate the inside geometry of the hollow shell after the straightening process. For example, it is allowed to regulate the inside diameter of the hollow shell on the end portion of the metal pipe or tube by pushing it into a die, and then the expansion process can be carried out.

It is allowed to subject the expanded portion to thermal treatment in order to get rid of the redundant strain or the residual stress on the expanded end portion that can be generated by the expansion process. Thermal treatment may also be carried out after expansion process in order to adjust the characteristics of the metal pipe or tube such as the strength and toughness.

In the above described method for manufacturing a metal pipe or tube, a seamless steel pipe or tube was manufactured to subject it to the expansion process, but it is also allowed to use a welded steel pipe or tube as a hollow shell for the expansion process.

Example

Measurement was carried out on the roundness and the precision of the inside surface and the precision of the outside surface on the metal pipes expanded by using plugs of various geometries.

TABLE 1

| | plug shape | | | | | | | | metal pipe shape | | | | | | | | |
|---|---|---|---|---|---|---|---|---|---|---|---|---|---|---|---|---|---|
| No | D0 (mm) | D1 (mm) | D2 (mm) | R1 (°) | R2 (°) | LR (mm) | LB (mm) | F1 = LR/((D1 − D2)/2) | D100 (mm) | thickness (mm) | D200 (mm) | DB (mm) | DC (mm) | LE (mm) | F2 = LE/((DB − DC)/2) | circularity (mm) | circularity evaluation |
| 1 | 250.0 | 288.4 | 285.5 | 5.0 | 0.5 | 165.2 | 20.0 | 115 | 280.0 | 10.0 | 288.4 | 308.4 | 305.3 | 177.3 | 115 | 0.3 | ○ |
| 2 | 250.0 | 288.4 | 285.5 | 5.0 | 1.0 | 82.6 | 20.0 | 57 | 280.0 | 10.0 | 288.4 | 308.4 | 305.3 | 87.9 | 57 | 0.3 | ○ |
| 3 | 250.0 | 288.4 | 285.5 | 5.0 | 2.5 | 33.0 | 20.0 | 23 | 280.0 | 10.0 | 288.4 | 308.4 | 305.3 | 35.5 | 23 | 0.4 | ○ |
| 4 | 250.0 | 288.4 | 285.5 | 5.0 | 3.0 | 27.5 | 20.0 | *19 | 280.0 | 10.0 | 295.0 | 315.0 | 311.9 | 9.4 | *6 | 0.8 | x |
| 5 | 250.0 | 288.4 | 285.5 | 5.0 | 5.0 | 16.5 | 20.0 | *11 | 280.0 | 10.0 | 301.0 | 321.0 | 317.8 | 3.2 | *2 | 0.9 | x |
| 6 | 220.0 | 247.2 | 244.7 | 5.0 | 0.5 | 141.6 | 20.0 | 115 | 240.0 | 30.0 | 247.2 | 307.2 | 304.1 | 176.6 | 115 | 0.3 | ○ |
| 7 | 220.0 | 247.2 | 244.7 | 5.0 | 1.0 | 70.8 | 20.0 | 57 | 240.0 | 30.0 | 247.2 | 307.2 | 304.1 | 87.6 | 57 | 0.3 | ○ |
| 8 | 220.0 | 247.2 | 244.7 | 5.0 | 2.5 | 28.3 | 20.0 | 23 | 240.0 | 30.0 | 247.2 | 307.2 | 304.1 | 35.3 | 23 | 0.3 | ○ |
| 9 | 220.0 | 247.2 | 244.7 | 5.0 | 3.0 | 23.6 | 20.0 | *19 | 240.0 | 30.0 | 249.0 | 309.0 | 305.9 | 17.0 | *11 | 0.7 | x |
| 10 | 220.0 | 247.2 | 244.7 | 5.0 | 5.0 | 14.1 | 20.0 | *11 | 240.0 | 30.0 | 250.0 | 310.0 | 306.9 | 9.3 | *6 | 0.8 | x |

*Out of the range defined by the invention

Method of Examination

Figure 8:
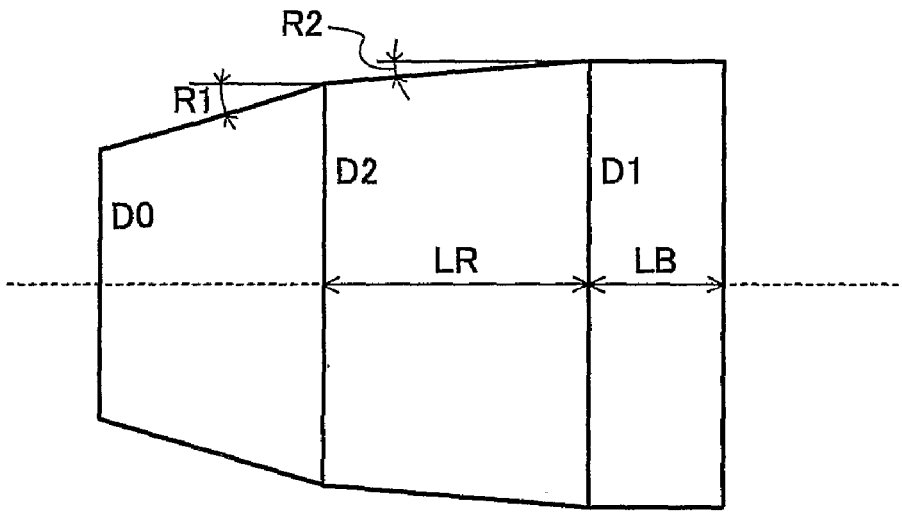
FIG. 8 is a side view of the plug used according to an example.

The geometries of the plugs used in the test are given in FIG. 8 and Table 1. The definitions of outside diameters D1 and D2, the taper angle R1 and R2 and axial distance LR are the same as those in FIG. 3. The diameter D0 is the diameter on the head end of the plug. The axial distance LB is the length of the parallel portion of the plug. The value F1 in Table 1 is calculated by the following Expression (3):

$$F1=LR/((D1-D2)/2) \quad (3)$$

The geometries of sample plugs Nos. 1 through 3 and 6 through 8 fell within the geometrical range of the present invention, whereas those of sample plugs 4, 5, 9 and 10 were outside the geometrical range of the present invention and the value F1 was less than the threshold value of Expression (1). Referring to the geometries of the sample plugs Nos. 5 and 10, the taper angles R1 and R2 were constant and the F1 value did not satisfy Expression (1).

The outside diameter of the metal pipe prepared for the test for each plug was 300 mm, and the length was 4000 mm. The values of the inside diameter D100 and the wall thickness were as given in Table 1.

The plugs were attached to the testing machine one by one, and the end portion of a metal pipe was expanded by using the sample plug attached to the machine. The plug was pushed into the metal pipe from the end until the distance between the head end of the plug and the end of the metal pipe became 200 mm. After pulling the plug out of the metal pipe, the inside diameter D200 of the metal pipe was measured on the end portion which is equivalent to the second hollow cylindrical portion 102 in FIG. 6D. A caliper gauge was used to measure the inside diameter of the expanded portion at eight points distributed in the same pitch in the circumferential direction. The mean value of the measured eight inside diameters was adopted as the inside diameter D200 of the expanded portion. The measured values of the inside diameter D200 are shown in Table 1.

The definition of the roundness was given by the difference between the largest and the smallest measured diameters in the circumferential direction. When the roundness was less than or equal to 0.55 mm, which is marked by an open circle in Table 1, the expanded pipe was accepted, and when it exceeded 0.5 mm, which is marked by "x" in Table 1, the expanded pipe was rejected.

The outside diameter DB of the second cylindrical portion was also measured. More specifically, by using a caliper gauge the outside diameter was measured at eight points in the circumferential direction in a constant pitch, and the mean value of the eight measured values were adopted as the outside diameter DB of the expanded portion. By using the value DB, the value DC=DB×0.99 was calculated. The axial distance LE lying on the outside surface between the point with outside diameter DC and the point with outside diameter DB was also measured by a caliper gauge. By using the measured outside diameters DB and DC, and the axial distance LE, the value F2 indicated in Table 1 was calculated by the following Expression (4):

$$F2=LE/((DB-DC)/2) \quad (4)$$

Result of Examination

As shown in Table 1, the inside diameters D200 of the metal pipe expanded by the plugs Nos. 1 through 3 were all 288.4 mm and were equal to the diameter D1 of the parallel portion of the plug used for each pipe. The roundness was less than 0.5 mm for all the pipes.

The inside diameters D200 of the metal pipe expanded by the plugs Nos. 6 through 8 were all 247.2 mm and were equal to the diameter D1 of the parallel portion of the plug used for each pipe. The roundness was less than 0.5 mm for all the pipes.

The geometries of the taper portions of the sample pipes Nos. 1 through 3 and Nos. 6 through 8, which are equivalent to the taper portion 103 of the metal pipe in FIG. 5D, were nearly the same as the geometries of the taper portion of each plug used for expansion. The value F2 fell within the range given by Expression (2).

The inside diameters D200 of the sample pipes Nos. 4, 5, 9, and 10 were all larger than the diameter D1 of the parallel portion of the plug. The reason for this discrepancy was attributed to the overshooting phenomenon which arose over the parallel portion of the plug. The roundness exceeded 0.5 mm for all the pipes, and the value F2 was less than the lower threshold value of Expression (2).

The wall thickness did not affect the dimensional precision and roundness of the expanded portion.

The embodiment of the invention has been shown and described simply by way of illustrating the present invention. Therefore, the invention is not limited to the embodiment described above and various changes and modifications may be made therein without departing from the scope of the invention.

INDUSTRIAL APPLICABILITY

The plug according to the invention can be widely adopted for expanding a metal pipe or tube, and most specifically it is applicable for the expansion of a line pipe and oil country tubular goods.

The invention claimed is:

1. A plug for use in expanding an inside diameter of an end portion of a metal pipe or tube, said plug having a circular cross section and including a taper portion and a parallel portion connected to a tail end of said taper portion, wherein a diameter of said taper portion gradually increases from a head end of said taper portion to the tail end of said taper portion where the diameter at the tail end of the taper portion is D1, an axial distance LR from a point of said taper portion where the diameter is D2, wherein D2=D1×0.99, to the tail end where the diameter is D1 satisfies Expression (1):

$$22 \leqq LR/(D1-D2)/2) \leqq 115 \quad (1)$$

a taper angle on a surface of the taper portion where the diameter of the taper portion is D2 is larger than or equal to a taper angle on a tail surface of said taper portion following a point where the diameter is D2, and a diameter of said parallel portion is D1.

2. A method of expanding an inside diameter of an end portion of a metal pipe or tube, comprising the steps of:

pushing a plug into the metal pipe or tube in an axial direction from an end of the metal pipe or tube for a prescribed distance; and stopping pushing said plug and pulling back in an inverse direction to an outside of the metal pipe or tube, wherein said plug having a circular cross section and including a taper portion and a parallel portion connected to a tail end of said taper portion, wherein a diameter of said taper portion gradually increases from a head end of said taper portion to the tail end of said taper portion where the diameter at the tail end of the taper portion is D1, an axial distance LR from a point of said taper portion where the diameter is D2, wherein D2=D1×0.99, to the tail end where the diameter is D1 satisfies Expression (1):

$$22 \leqq LR/((D1-D2)/2) \leqq 115 \quad (1)$$

a taper angle on a surface of the taper portion where the diameter of the taper portion is D2 is larger than or equal to a taper angle on a tail surface of said taper portion following a point where the diameter is D2, and a diameter of said parallel portion is D1.

3. A method of manufacturing a metal pipe or tube, comprising the steps of:

piercing a billet in an axial direction to manufacture a hollow shell;

elongating said hollow shell in the axial direction;

sizing an outside diameter of said elongated hollow shell to manufacture said metal pipe or tube;

pushing a plug into said metal pipe or tube in the axial direction from an end of the metal pipe or tube for a prescribed distance; and stopping pushing said plug and pulling back in an inverse direction to an outside of the metal pipe or tube, wherein said plug having a circular cross section and including a taper portion and a parallel portion connected to a tail end of said taper portion, wherein a diameter of said taper portion gradually increases from a head end of said taper portion to the tail end of said taper portion where the diameter at the tail end of the taper portion is D1, an axial distance LR from a point of said taper portion where the diameter is D2, where D2=D1×0.99, to the tail end where the diameter is D1 satisfies Expression (1):

$$22 \leqq LR/((D1-D2)/2) \leqq 115 \quad (1)$$

a taper angle on a surface where the diameter of the taper portion is D2 is larger than or equal to a taper angle on a tail surface of said taper portion following a point where the diameter is D2, and a diameter of said parallel portion is D1.

4. A metal pipe or tube comprising:

a first hollow cylindrical portion near a center portion of said metal pipe or tube, a second hollow cylindrical portion on at least one of the two end portions of said metal pipe or tube, and a taper portion connecting said first and second hollow cylindrical portions, wherein an outside diameter of said first hollow cylindrical portion is DA, an outside diameter of said second hollow cylindrical portion is DB, which is larger than the outside diameter DA of said first hollow cylindrical portion, an outside diameter of said taper portion gradually increases from DA to DB from said first hollow cylindrical portion to the second hollow cylindrical portion, and an axial distance LE between points DC and DB, where the diameter DC=DB×0.99, satisfies the following Expression:

$$22 \leqq LE/(DB-DC)/2) \leqq 115.$$

* * * * *